United States Patent [19]

Tyson

[11] 4,239,325

[45] Dec. 16, 1980

[54] SELF-ALIGNING MULTI-PIN CONNECTOR

[76] Inventor: Thomas E. Tyson, 2686 Coldsprings Dr., Xenia, Ohio 45385

[21] Appl. No.: 29,582

[22] Filed: Apr. 12, 1979

[51] Int. Cl.[3] ..... H01R 13/631

[52] U.S. Cl. ..... 339/89 M; 339/66 M; 339/186 M

[58] Field of Search ..... 339/64 R, 64 M, 66 M, 339/65, 89 R, 89 M, 184 R, 184 M, 186 R, 186 M, 16 R; 285/27

[56] References Cited

U.S. PATENT DOCUMENTS

| | | | |
|---|---|---|---|
| 3,082,396 | 3/1963 | Bernhard | 339/65 |
| 4,162,816 | 7/1979 | Malsot | 339/64 M |

FOREIGN PATENT DOCUMENTS

| | | | |
|---|---|---|---|
| 2646093 | 4/1978 | Fed. Rep. of Germany | 339/65 |

*Primary Examiner*—Richard B. Lazarus

*Assistant Examiner*—Eugene F. Desmond

*Attorney, Agent, or Firm*—Donald J. Singer; Casimer K. Salys

[57] ABSTRACT

A self-aligning connector in which the corresponding male and female members are rotated into mating alignment by the conversion of axially directed force into rotational torque about the mating axis. The aligning feature resides in each member having a corresponding intermediate cylindrical body with an elongated, axial keying protrusion which extends by defined contour into a keyway on the opposite side of the cylindrical body. Misalignment of the connector members during mating causes the keying protrusions to strike the contours on the opposite cylindrical body obliquely so as to impart a torque until the keying protrusions, keyways and connector mating elements are properly oriented. Once oriented, the connector members translate along the mating axis to an engaged state in response to the continued application of axially directed force.

6 Claims, 8 Drawing Figures

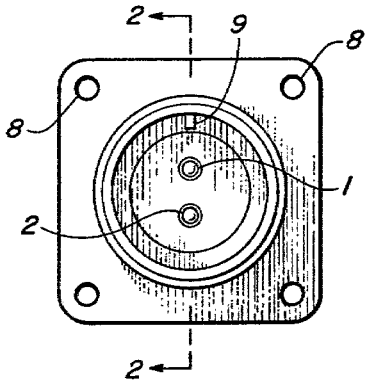
FIG. 1
PRIOR ART
FIG. 2
PRIOR ART
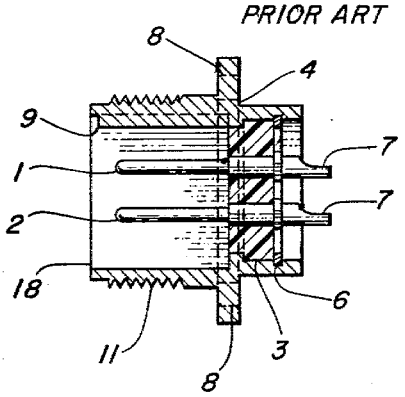
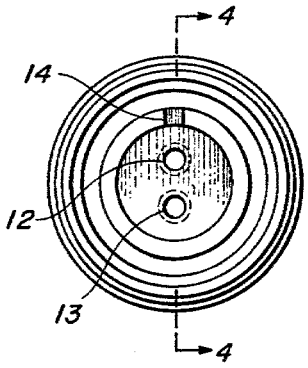
FIG. 3
PRIOR ART
FIG. 4
PRIOR ART
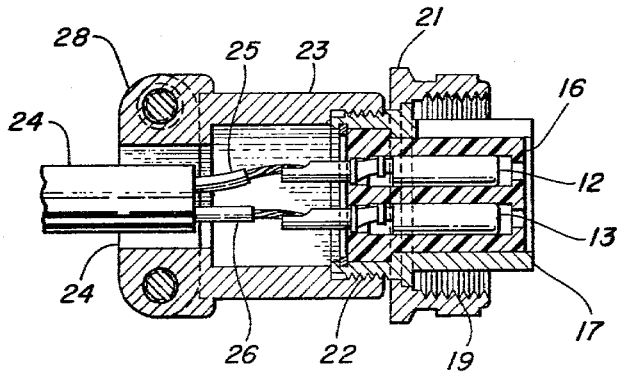

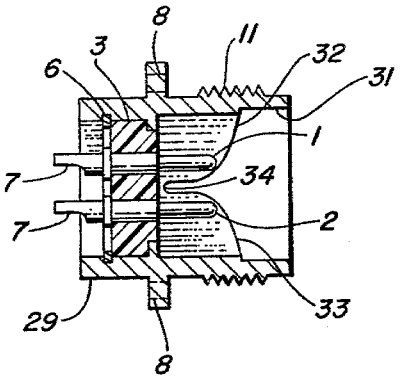
FIG. 5
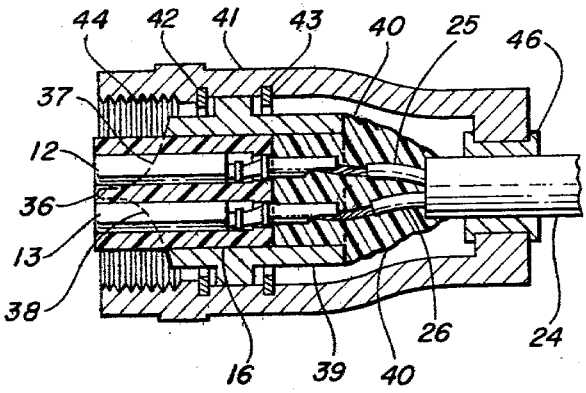
FIG. 6
FIG. 7
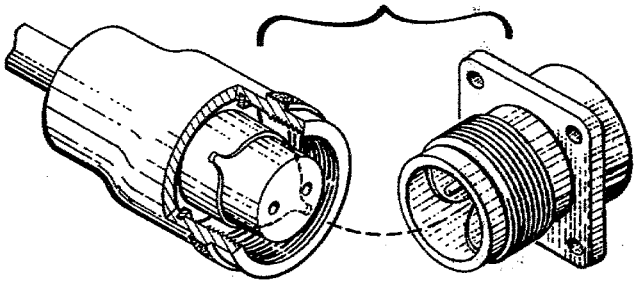
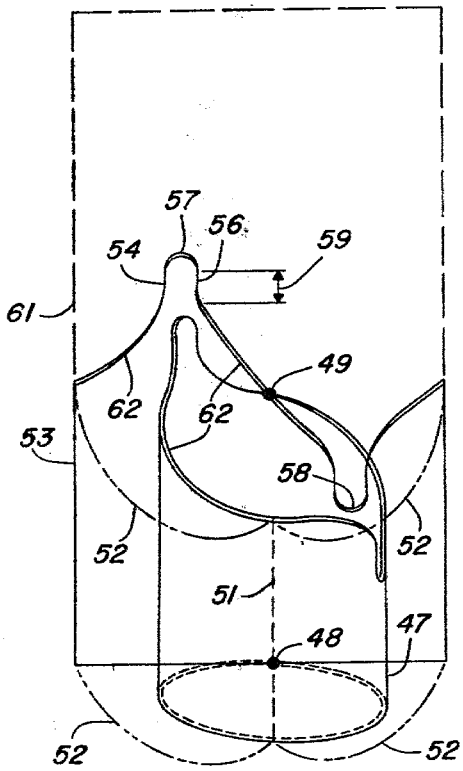
FIG. 8

SELF-ALIGNING MULTI-PIN CONNECTOR

RIGHTS OF THE GOVERNMENT

The invention described herein may be manufactured and used by or for the Government of the United States for all governmental purposes without the payment of any royalty.

BRIEF SUMMARY

The present invention is directed to an electrical connector having male and female members which rotate into an aligning orientation of the pins and corresponding sockets upon the imposition of an axial mating force. In one form, the male and female connector members are concentric cylindrical regions of three functional groups. The inner regions are generally made of electrical insulating material and fixedly retain the connector pins and pin sockets. The succeeding cylindrical regions contain corresponding sets of keyways, keying protrusions and camming contours, and are fixedly attached to the inner regions. The external regions contain the shell or housing by which the inner regions may be held in a mated state with corresponding sets of threads or bayonet type retention means. Preferably, at least one of the two connector member external cylindrical regions is rotatable about its inner cylindrical regions.

Attempting to mate the male and female connector members as taught by this invention when the pins are not aligned causes the keying protrusions in one member to make contact with camming contours in the cylindrical walls of the other member. This contact is converted to a torque in the direction of alignment which rotates the pins and sockets into alignment when sufficient axial force is imposed to overcome cable stiffness. The keying protrusions and keyways align at the same time that the pins and sockets align, allowing the subsequent axially directed force to fully engage all the mating parts. In one form, the axial force is directed through a rotatably mounted shell or housing.

DESCRIPTION OF THE DRAWINGS

FIGS. 1 and 2 are respectively an end view and cross-section of a conventional, chassis mounted male connector member.

FIGS. 3 and 4 are respectively an end view and cross-section of a conventional cable mounted female connector member which is matable to the connector member depicted in FIGS. 1 and 2.

FIG. 5 is a cross-section of one embodiment of the invention having the functional equivalent of the chassis mounted male connector member.

FIG. 6 is a cross-section of the cable mounted female connector member embodiment which is matable to the connector member depicted in FIG. 5.

FIG. 7 is a partial cutaway isometric of the male and female connector members.

FIG. 8 is a development schematic showing one embodiment of the keyways, keying protrusions and camming contours forming the intermediate cylindrical region.

DETAILED DESCRIPTION

Conventional electrical connectors of the type having pins and pin sockets in opposing members must, of necessity, be manually rotated into alignment prior to actual mating of the respective pins and sockets. To insure that the correct pins and sockets are joined, mating is structurally inhibited until matching sets of keys and keyways are aligned. In such structural arrangements the mating process entails two independent steps, a manual rotation to align followed by an axial translation to force engagement of the pins and sockets. Once mated, the male and female connector members are held together by an outer housing which is journaled onto one member and engages the other member by threads, bayonet attachment or other suitable means.

Unfortunately, not all cable connectors are readily accessible, flexible, and mated under ideal working environments. Often, a cable end connector member must be mated to a corresponding member which is attached to a chassis in a location where the limited access permits entry to little more than the connector and cable. Rotating the connector member to align the pins and sockets when the keyways are visually concealed in such tight quarters frequently induces connector damage when axial force is imposed before alignment is completed. Furthermore, the immediate and potential problems are exacerbated during the manual rotation process, when the conventional radial keying pins and keyways chafe against each other until aligned, leaving deposits of electrically conductive particles dispersed within the connector interior.

Representative examples of conventional connector members appear in FIGS. 1–4. A chassis mount male connector member is shown from the mating end in FIG. 1 and in cross-section at section lines 2—2 in FIG. 2. Pins 1 and 2 are fixed in electrical insulator 3, which itself is nonrotating and axially retained in connector body 4 by retaining ring 6. Cable wires are attached to pins 1 and 2 by soldering into recesses 7. Connector body 4 is attached to a chassis by suitable means through mounting holes 8. Orientation of the pins with the corresponding sockets in the female connector member is by a single key, 9. Threads 11 are engaged by an outer housing journaled onto the female member, holding the connector members together after the pins and sockets are mated.

FIG. 3 is a mating end view of the female counterpart to the above-described male connector member. The same is shown in the cross-section of FIG. 4, taken through section line 4—4 in FIG. 3. As is recognized by those practicing in the art, the connector member is of a conventional cable mounted configuration. Pin sockets 12 and 13 correspond to pins 1 and 2 as does keyway 14 to key 9. The sockets are fixed in nonrotating insulator 16, which is itself fixed within connector body 17. The outside diameter of body 17 just fits within opening 18 of body 4 when key 9 and keyway 14 are aligned with a common axis for insertion. Threads 19 on journaled outer housing 21 engage threads 11 to hold the male and female connector members in a mated state. At the opposite end of body 17 are threads 22 by which connector end 23 is fixed to body 17 and outer housing 21 is retained on the connector member. Cable 24 with wires 25 and 26 attached to pin sockets 12 and 13 extends through opening 27 in connector end 23 and is generally restrained by conventional strain relief assembly 28, also attached to connector end 23.

Attention is now directed to FIGS. 5 and 6 where the corresponding male and female ends of one invention embodiment are shown individually in the cross-section. The general structure of the male member depicted in FIG. 5 is functionally similar to the chassis mounted member appearing in and described with reference to FIG. 2. For purpose of comparison, identical parts in FIGS. 2 and 5 are designated by identical reference numerals. Connector body 29 in FIG. 5 is distinguishable from connector body 4 in FIG. 2 by the shape and function of the intermediate cylindrical region, the camming body. The half section of the connector member in FIG. 5 depicts the camming body to be in the form of a bored segment 31 extending inward along contoured walls 32 and 33 until the walls converge into keyway 34. The half section not shown in FIG. 5 differs from the one appearing there. Its geometric shape will become evident from the forthcoming description.

The corresponding female connector member in FIG. 6 is similarly designated with identical reference numerals when parts are identical in structure and function to those appearing in FIG. 4. Keying protrusion 36 of the connector member in FIG. 6 is made to fit directly into keyway 34 of the male connector member in FIG. 5 when contoured walls 37 and 38 respectively abut walls 32 and 33. Electrical insulator 16 is fixedly mounted in body 39 of the female connector member, which is freely rotatable within cylindrical shell or housing 41 and is axially limited by retaining rings 42 and 43. At one end of housing 41 are inside threads 44 which engage threads 11 on the male connector member to hold a mated state. The opposite end of housing 41 holds bushing 46, which freely rotates in housing 41 but is securely clamped about cable 24 to restrain axial travel thereof. Bushing 46 serves both as a strain relief for cable 24 and a means for decoupling rotation in the cable and female connector body 39 from rotation of housing 41. Any relative torque between body 39 and cable 24 is transmitted through rigid adhesive or potting compound 40, which encases the region between these confronting parts. One skilled in the art will recognize that the retention function served by threads 11 and 44 on the corresponding connector members may be replaced by a bayonet type or other suitable holding means.

The connector members appearing sectionally in FIGS. 5 and 6 reappear in the partial cutaway isometric of FIG. 7. The shapes of the keyways, keying protrusions and matching contours are further revealed.

Since the shapes of the intermediate cylindrical region are not readily perceivable, further elaboration, in the form of a development schematic, is provided through FIG. 8. It should be noted at the onset that the shapes of the intermediate cylindrical bodies in the two connector members are substantially mirror images of each other.

Consider intermediate cylindrical body 47 as shown in FIG. 8. If cylindrical body 47 is fixed to a plane along the line between points 48 and 49, on its far side, and is cut along line 51 on the near side, the cylindrical body may be unrolled along dashed lines 52 into a single planar surface, as shown by shape 53. The cylinder's representation in shape 53 is easier to perceive and analyze. Walls 54 and 56 of keying protrusion 57 are substantially parallel to each other and the cylindrical axis, as are the walls of analogous keyway 58. Nonetheless, in an actual connector the thickness of the cylindrical body cannot be overlooked, which effectively means that keying protrusion 57 and keyway 58 are actually segments of arc, when viewed along the cylindrical axis, and walls 54 and 56 are not perfectly parallel. The nominal length 59 of keying protrusion 57 is approximately equal to the depth to which the connector member pins enter into their respective sockets. These conditions are of course dictated by the fact that the keying system and pins-sockets must be completely aligned before the two connector members are mated by direct axial translation.

The particularly beneficial operating characteristics of the connector embodying the invention may also be illustrated with reference to FIG. 8. If mirror image 61 of shape 53, representing the shape of the counterpart connector member, is brought into mating relationship with the shape 53 when the intermediate cylinders they represent are correctly oriented, the keying protrusions, camming contours and keyways fit together without interference. Conversely, if the intermediate cylinders are not correctly oriented, indicating that the connector member pins and sockets are likewise misaligned, the keying protrusions strike contoured cylinder walls 62 on the opposing member. Analogous to a cam, an oblique contact between contoured walls 62 and the keying protrusions, preferably rounded at their extreme ends as shown, imparts a torque into the camming body of each connector member in the aligning direction when an axially directed mating force is imposed.

The degree to which axially directed force is converted to torque is determined by the shape of contoured camming walls 62. Preferably, the walls are such that the torque produced by an axial mating force of substantially constant magnitude is sufficient to overcome the opposing torque created by cable twist. Generally, this opposing torque from the cable being twisted is nearly proportional to the angular rotation of that cable. Furthermore, in the immediate region of the keyways the shape of the camming contours must also be sufficiently smooth and gradual to permit the keying protrusions entry into the keyways without binding.

As shown in FIG. 8, keying protrusion 57 and keyway 58 are disposed on substantially opposite sides of their members. It is fully contemplated that relative orientations, at angles different than 180 degrees, are feasible and that such orientations serve as a means for indexing and thereby selectively coding each connector member to a prescribed mate.

A benefit attributable to one particular embodiment of the invention may be understood by referring to FIG. 6. Since alignment of the connector pins and sockets is self-initiated, a chassis mounted connector member, such as shown in FIG. 5, in a location where a conventional connector is difficult to attach, may be mated to a connector member of the type appearing in FIG. 6 merely by extending the cable end of housing 41. The two members are joined by a single axial force on the cable end of housing 41 which serves to both align the connector member and mate the respective pins and sockets. Thereafter, the housing of the cable connector member may be threaded or otherwise attached to the chassis connector member to retain the mated state.

Disengaging the connector members described above illustrates another characteristic of the embodying structure. Since the keying protrusions and keyways remain engaged until the pins are completely withdrawn from the sockets, the structure inhibits axial and torquing induced pin damage during both the mating and disengagement sequences without the chafing frequently produced by conventional indexing systems.

Those skilled in the art will readily recognize that the invention is not limited to connector members having a single keying protrusion and keyway in each member, or electrical connectors alone. Likewise, any combination of fixed, rotating, cable mounted, or chassis mounted connector member styles are contemplated and fully within the scope and spirit of this invention.

I claim:

1. A connector comprising:

a. first and second body members adapted to be joined and separated by relative movement of said body members along a common axis;

b. cooperative retaining means on each of said body members arranged to interlock with said body members in joined condition;

c. at least one of said body members having a rotatable connection to its corresponding retaining means; and d. cooperative cams of mirrored relationship on each body member, each cam having curvilinear contoured surfaces terminated by a key and keyway.

2. A connector as defined in claim 1, having a plurality of joinable parts on each of said body members, said parts being properly aligned in pairs only in the correct orientation of said body members, and at least one of said pairs being eccentric to said axis.

3. A connector as defined in claim 2, wherein said joinable parts include at least one set of mating parts which are mated when said body members are fully joined.

4. A connector as defined in claims 1, 2, or 3, wherein said cam means comprises complementary cylindrical cam surfaces surrounding and fixed to said body members.

5. A connector as defined in claim 3, wherein said keys and keyways are axially longer than the distance by which the mated parts are joined.

6. A connector as defined in claim 4, wherein said curvilinearly contoured surfaces are symmetric.

* * * * *

UNITED STATES PATENT AND TRADEMARK OFFICE

CERTIFICATE OF CORRECTION

PATENT NO. : 4,239,325

DATED : December 16, 1980

INVENTOR(S) : Thomas E. Tyson

It is certified that error appears in the above-identified patent and that said Letters Patent are hereby corrected as shown below:

Col 6, line 11, change "cam means comprises" to -- cams comprise --.

Signed and Sealed this

*Twelfth* Day of *May 1981*

[SEAL]

*Attest:*

RENE D. TEGTMEYER

*Attesting Officer*

*Acting Commissioner of Patents and Trademarks*